US009595176B2

(12) United States Patent
Conaty

(10) Patent No.: US 9,595,176 B2
(45) Date of Patent: Mar. 14, 2017

(54) INVENTORY PROTECTION SYSTEM

(71) Applicant: Francis X. Conaty, Chester, NJ (US)

(72) Inventor: Francis X. Conaty, Chester, NJ (US)

(73) Assignee: PAIGE ELECTRIC COMPANY, LP, Union, NJ (US)

( * ) Notice: Subject to any disclaimer, the term of this patent is extended or adjusted under 35 U.S.C. 154(b) by 0 days.

(21) Appl. No.: 14/823,705

(22) Filed: Aug. 11, 2015

(65) Prior Publication Data

US 2016/0042619 A1 Feb. 11, 2016

Related U.S. Application Data

(60) Provisional application No. 62/035,907, filed on Aug. 11, 2014.

(51) Int. Cl.

| | |
|---|---|
| ***G08B 13/14*** | (2006.01) |
| ***G08B 25/08*** | (2006.01) |
| *G08B 21/00* | (2006.01) |
| *G08B 13/12* | (2006.01) |

(52) U.S. Cl.

CPC ..... *G08B 13/1409* (2013.01); *G08B 25/08* (2013.01); *G08B 13/12* (2013.01); *G08B 13/14* (2013.01); *G08B 21/00* (2013.01)

(58) Field of Classification Search

USPC ..... 340/568.4

See application file for complete search history.

(56) References Cited

U.S. PATENT DOCUMENTS

| | | | | |
|---|---|---|---|---|
| 4,746,909 A * | 5/1988 | Israel | G08B 13/1445 | 340/568.1 |
| 6,337,633 B1 * | 1/2002 | Foseide | G08B 13/1418 | 340/540 |
| 2009/0303046 A1 * | 12/2009 | Eckert | E05B 45/005 | 340/568.4 |

* cited by examiner

*Primary Examiner* — Leon-Viet Nguyen

(74) *Attorney, Agent, or Firm* — Cook Alex Ltd.

(57) ABSTRACT

An inventory protection system has a plurality of cable segments with connectors on the ends thereof. The connectors permit pairs of cable segments to be releasably mechanically and electrically connectable to one another to form a continuous cable loop. A circuit connected to the cable loop periodically generates a test signal in the cable loop and checks to see if the test signal is able to travel all the way around the cable loop. The circuit generates an alarm signal if the test signal cannot travel all the way around the cable loop.

20 Claims, 2 Drawing Sheets

INVENTORY PROTECTION SYSTEM

CROSS-REFERENCE TO RELATED APPLICATION

This application claims the benefit of U.S. Patent Application Ser. No. 62/035,907, filed Aug. 11, 2014, the disclosure of which is incorporated herein by reference in its entirety.

FIELD OF THE DISCLOSURE

The present disclosure is directed to security devices for large articles.

BACKGROUND

Retail stores selling relatively large yet movable items such as outdoor furniture, lawn mowers and tractors, snow blowers, grills, bicycles and the like often find it desirable to display such items outside the confines of their building. Typically the inventory is displayed at or near the entrance to the store to attract the attention of shoppers as they enter or leave the store. The storefront often offers the only suitable space large enough to display more than one or two bulky items such as outdoor furniture or power equipment.

Securing such openly displayed inventory from theft and damage is a problem. This is especially true at the close of business. In the past store owners seeking to secure outdoor inventory have had to choose among several undesirable options. One option is to physically move the inventory back into the confines of the store's building. This takes considerable time at a point in the workday when employees are anxious to leave the premises, leading to the risk of damage to the inventory. It also requires considerable inside storage space, the absence of which is commonly what lead to the outdoor display in the first place. Thus, moving the inventory inside usually means placing it in a temporary location where it will interfere with some other normal operation of the store.

An alternative to moving the inventory back into the store is to leave it out but physically secure it to prevent removal. This typically meant use of long metal chains or stranded steel cable attached somehow to the items and with both terminal ends of the chain or cable anchored and locked to the property. The inventory items sometimes do not have a convenient attachment point for the chain or cable, which requires the chain to be looped through or around a handle or a similar component not designed for the purpose, sometimes with resultant damage to the finish of the item. A further alternative to the chain or steel cable is a long, single length of electrical cable secured to the items and connected to an alarm system. While an insulated electrical cable is less likely to damage the inventory than a chain or steel cable, it shares with the chain and steel cable another drawback.

The basic problem with prior, single-length physical or electrical securement devices was that, during business hours, should a customer want to purchase one of the products that was anywhere remote from the ends of the cable, the seller has to disconnect the entire inventory between the two end pieces and the item being sold, just to release the item being delivered to the customer. This requires significant time and labor. Plus every time you disconnect and reconnect the securement devices you add to the chances of damaging the unsold inventory.

Securement devices that incorporate an electrical cable connected to some type of electrical alarm circuit have the further problem of electrically connecting the securement device to the alarm circuit. While electrical connections between the alarm circuit and the cable of the securement device could be hard-wired to the securement cable, this limits the flexibility of such a device in that at least one end, and possibly both ends, of the cable must be physically connected to the alarm circuit. While a wireless connection between the alarm circuit and the cable of the securement device is possible, powering the wireless connection is a problem. While power to the wireless connection could be supplied by plugging the cable into a regular power outlet, doing this limits where the securement device can be installed and essentially defeats the purpose of having a wireless connection in the first place. Battery power for a wireless connection, on the other hand, presents its own issues in terms of battery life and limitations on the length of a cable that can be used with a battery-powered alarm circuit.

SUMMARY

The inventory protection system of the present disclosure includes a sensor and reporting device incorporated into an electrical cable loop made of a plurality of short, manageable lengths or cable segments of insulated electrical wire that can be electrically and mechanically connected to and disconnected from one another. As used herein the term "cable segment" will refer to a single, discrete length of electrical cable with at least one connector on at least one of its end. The term "cable loop" will refer to a plurality of cable segments which are electrically and mechanically connectable to one another in end to end fashion. Forming the electrical cable loop of the present disclosure from multiple cable segments allows the cable loop to be assembled to any length desired. It also allows separation of segments at multiple locations if desired. During store hours, when a sale has been made and an item needs to be removed from the security cable, the sensor and/or reporting device can be temporarily turned off and the connectors of mating cable segments of the cable loop can be disconnected in close proximity to the sold product to allow its intentional removal from the inventory protection system. This multi-segmented, insulated security cable eliminates a majority of the time, labor and damage associated with complete removal and reinstallation of a single-length security cable. Details of a cable segment of this type are shown in U.S. Pat. No. 9,203,185, issued Dec. 1, 2015, the disclosure of which is incorporated by reference herein.

In another aspect, the present disclosure concerns an inventory protection system having a plurality of electrical cable segments formed in a cable loop and electrically connected to a sensor circuit for detecting a discontinuity in the cable loop. When the sensor detects a discontinuity, it activates either an alarm circuit connected to the cable loop or a reporting device that sends an activation signal to a remote alarm circuit. For convenience and security, it is preferred to maintain the alarm circuit in a secure location which is remote from the cable loop, e.g., inside the store building. In this case the inventory protection system includes a reporting device which communicates with the remote alarm circuit to notify the alarm circuit of a breach in the cable loop. The sensor circuit is battery powered and includes features which maximize battery life and maximize the number of cable segments that can be used, i.e., the sensor circuit maximizes the length of the cable loop.

DETAILED DESCRIPTION OF THE EMBODIMENTS

Figure 1:
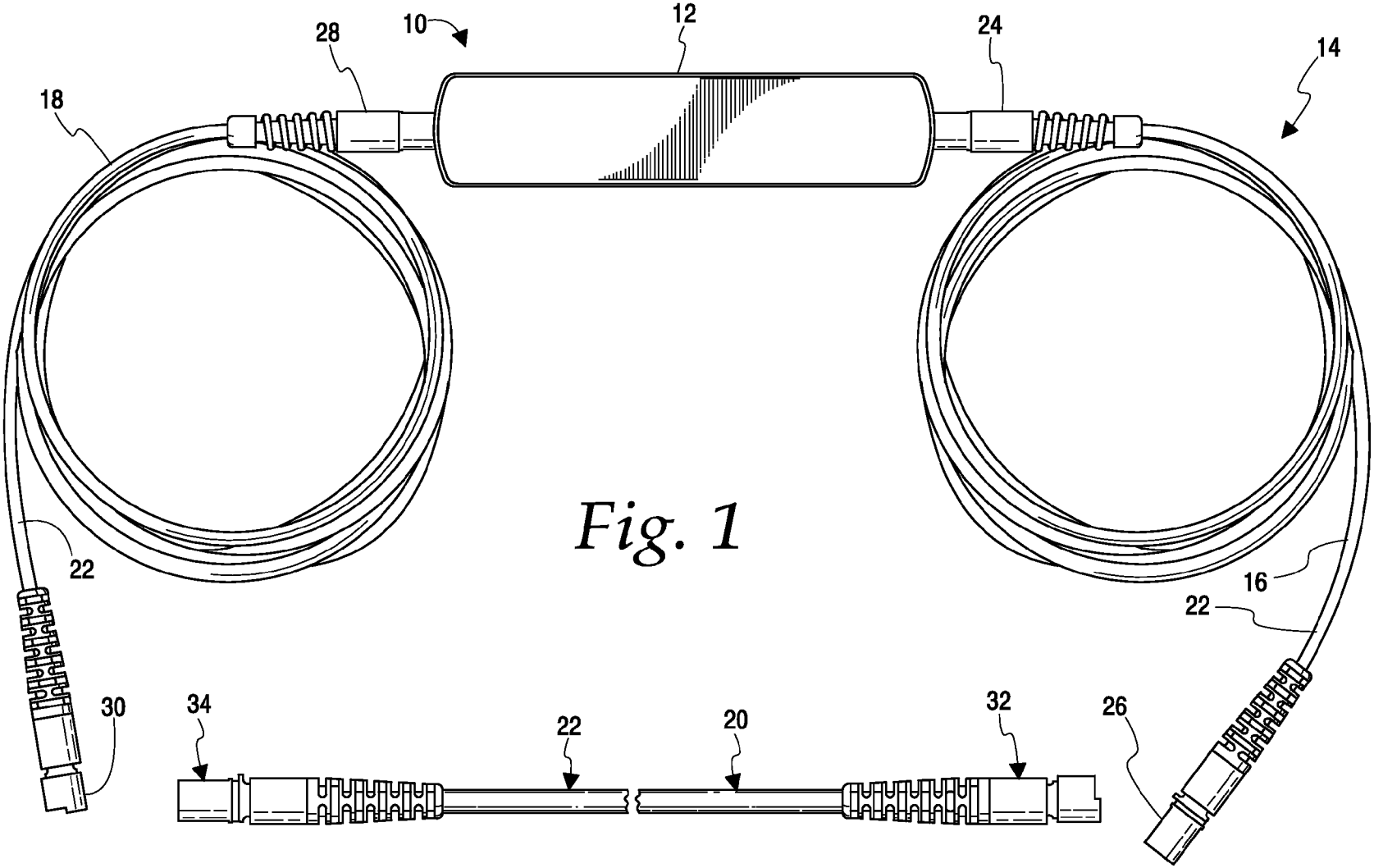
FIG. 1 is a plan view of the sensor housing connected to two single-ended cable segments, with a double-ended cable segment shown schematically between the connectors of the single-ended cable segments.

The present disclosure is directed to an inventory protection system shown generally at 10 in FIG. 1. The system includes a sensor circuit contained in a sensor housing 12 and a cable loop 14 for securing articles. The cable loop 14 comprises a plurality of cable segments. Three such cable segments are shown in FIG. 1. These include a male single-ended segment 16, a female single-ended segment 18 and a double-ended segment 20. The reference to single-ended and double-ended refers to the number of connectors found on the ends of a segment. In the illustrated embodiment the single-ended segments 16, 18 have one end hard-wired to a circuit board in the sensor housing 12 and the other end is provided with a connector for selective engagement with another segment. As an alternative construction, instead of having the single-ended segments hard wired to the sensor circuit board, the housing itself could be equipped with a male and female connector. These connectors would be hard wired to the sensor circuit board but could also selectively connect to double-ended segments. In either case it will be understood that multiple numbers of double-ended segments could be used as needed.

Each cable segment has a length of an insulated electrical conductor, preferably inside an outer insulating jacket 22. The male single-ended segment 16 has at one end a water-tight strain relief member 24 attached to the housing 12. The other end of the male single-ended segment 16 has a male connector 26. Similarly, the female single-ended segment 18 has at one end a water-tight strain relief member 28 attached to the housing 12. The other end of the female single-ended segment has a female connector 30. The double-ended segment 20 has a female connector 32 at one end and a male connector 34 at the other end. While only one double-ended segment is shown, it will be understood that a plurality of double-ended segments will typically be connected between the single-ended segments. For example, the male connector 26 of the male single-ended segment 16 could be being mechanically and electrically connectable to the female connector 32 of an adjacent double-ended segment 20. Likewise, that double-ended segment's male connector 34 could be being mechanically and electrically connectable to the female connector 30 of the adjacent female single-ended segment 18 to complete the cable loop 14. Additional, intervening double-ended segments could be added according to the needs of a particular application. The lengths of the segments could also vary. Furthermore, the segment lengths need not be all the same. It has been found that a segment length of about 15 feet is practical and a total, combined length of all segments of the cable loop can extend to about 350 feet.

Figure 2:
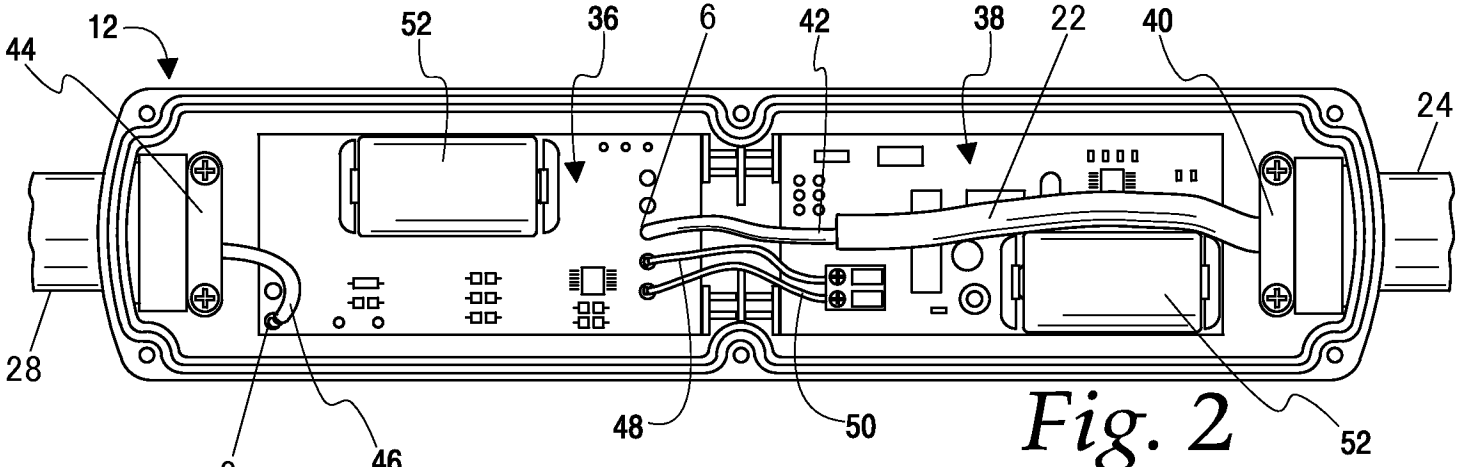
FIG. 2 is a plan view of the sensor housing with its cover removed to reveal the circuit boards inside.

FIG. 2 illustrates the interior of the sensor housing 12. Mounted inside the housing are a sensor circuit board 36 and a reporting unit circuit board 38. The outer jacket 22 of the male single-ended segment 16 enters the housing 12 adjacent the reporting unit circuit board 38 where the jacket is held fixed by an internal strain relief member 40. The outer jacket 22 extends and overlies about three quarters of the length of the reporting unit circuit board. An insulated conductor 42 inside the jacket 22 protrudes from the end of the jacket and is attached to the sensor circuit board at 6. The female cable segment 18 enters the end of the housing opposite where the male cable segment 16 enters. There is an internal strain relief member 44 clamped on either the outer jacket or internal conductor. A conductor 46 that extends through the jacket 22 is attached to the sensor circuit board at 2.

Other features in the sensor housing 12 include a pair of jumper wires. A ground jumper 48 extends between the sensor circuit board 36 and the reporting unit circuit board 38. The point of attachment on the sensor circuit board 36 is grounded. The second jumper wire is a driver jumper 50. It connects the driver output of the reporting unit circuit board 38 to the drive input terminal of a line driver on the sensor circuit board 36, as will be explained below. Each of the circuit boards 36 and 38 is powered by its own 3-volt battery 52, such as a CR123A, although other types of batteries could be used.

Figure 3:
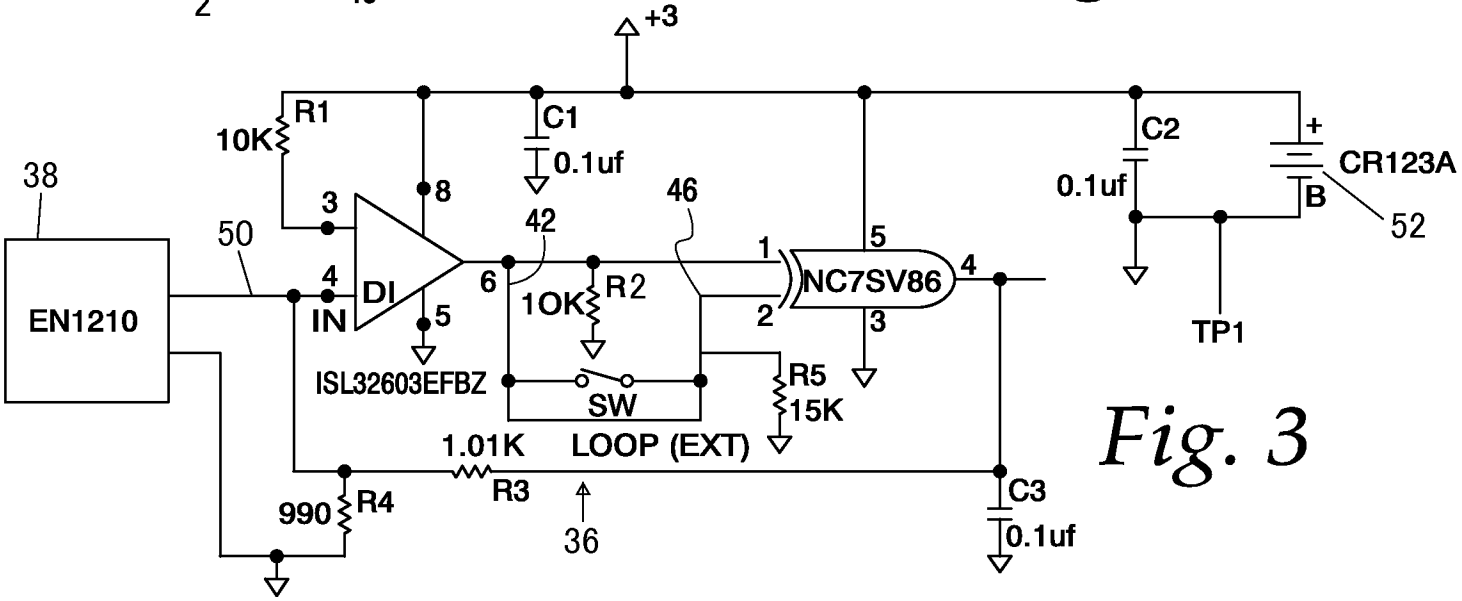
FIG. 3 is a circuit diagram of the sensor circuit and reporting circuit of the present invention.

FIG. 3 illustrates a circuit diagram of the sensor circuit board 36 and its connection to the reporting unit circuit board 38. As just mentioned, the sensor circuit board 36 includes a battery 52, the positive terminal of which is connected to a resistor R1. Capacitors C1 and C2 condition the line from the battery 52 to R1. Resistor R1 in turn connects to pin 3 of an operational amplifier DI. This device is set up to run as a line driver. It may be an ISL32603EFBZ available from Intersil Corporation of Milpitas, Calif. The other input to the line driver DI on its pin 4 is the input, via jumper 50 from the reporting unit circuit board 38.

The reporting unit circuit board 38 is shown as an EN1210 transmitter available from Inovonics Corporation of Louisville, Colo. This transmitter communicates wirelessly with a receiver in an alarm base station (not shown) to report, for example, either a normal status or an alarm status. Alternately, battery life may be extended by having the transmitter report to the alarm base station only when an alarm condition exists. The alarm base station is located remotely from the cable loop 14, preferably inside the building where it can be powered from regular 120 VAC power to take appropriate action when the transmitter EN1210 reports an alarm condition. Such action may include sounding an audible alarm, turning on one or more lights, activating cameras, locking doors or gates, calling authorities, or some combination of these or similar actions to prevent a theft. The base station can be deactivated to permit installation of the cable loop or intentional, authorized removal of an item from the protected inventory.

Returning to FIG. 3, the output of line driver DI on its pin 6 connects to both the conductor 42 of the male single-ended segment 16 and to the pin 1 input of an exclusive OR (XOR) gate which is labeled NC7SV86. A suitable XOR gate with this part number is available from Fairchild Semiconductor Corporation of San Jose, Calif. Resistor R2 is also attached to the pin 1 input. The other input to the XOR gate, on its pin 2, is the other end of the loop cable 14, namely the conductor 46 of the female single-ended segment 18. Resistor R5 is also attached to the pin 2 input. R5 gives stability to the XOR gate input when the loop is open. This prevents self-oscillation of the XOR gate. The output pin 4 of the XOR gate is fed back to the driver input of the line driver DI through the voltage divider provided by resistors R3 and R4. The values chosen for R3 and R4 improve long loop performance. A capacitor C3 on this feedback line snuffs out a short spike from the XOR gate, as will be explained below.

An optional switch SW may be included to permit local deactivation of the sensor circuit. If the switch is closed, the cable loop could be opened without triggering an alarm. The switch would be open during normal use. If no switch is provided, deactivation of the system would be effected at the alarm base station. That is, for an authorized person to remove an item from inventory, he or she would turn off the alarm base station. Then separation of two cable segments would cause the reporting unit 38 to transmit an alarm signal but the deactivated alarm base station would not act on that transmission.

The use, operation and function of the inventory protection system are as follows. It will be understood that the articles to be protected could be just about anything, but a common application would be large store inventory such as outdoor furniture, lawn mowers and tractors, snow blowers, grills, bicycles and the like. During securement the cable loop is separated at at least one of the mating connector pairs, leaving a free end to thread through some part of the article such as a handle, support brace, steering wheel or similar component. Once all of the items are thus secured, the mating connector pairs are joined mechanically and electrically, thereby forming a complete cable loop. In terms of the circuit diagram in FIG. 3, connecting all of the cable segments together completes the circuit from pin 6 of line driver DI to pin 2 of the XOR gate. Once this is complete, the alarm base station is activated to receive transmissions from the EN1210 transmitter.

The EN1210 device periodically generates a short pulse of 3 volts on its driver line, which is connected to input pin 4 of line driver DI. For example, the pulse may be 10 microseconds long and occur every 50 milliseconds. The EN1210 is set up so that it expects to see what it thinks is a short circuit, e.g., something less than 700 or 800 ohms or so. When the output of the XOR gate is low, the EN1210 thinks it is shorted and therefore everything is normal. When the output of the XOR gate is high, the EN1210 thinks it is seeing a higher impedance and therefore an alarm should be triggered. It does so by sending a transmission to the alarm base station reporting an alarm condition has occurred.

It will be noted that when there is no pulse from the EN1210 the output of line driver DI is necessarily low and as a result both input pins 1 and 2 of the XOR gate are low, causing a low output of the XOR gate. This is what EN1210 expects and no alarm is triggered. When there is a pulse from the EN1210 the output of the line driver DI goes high and a result input pin 1 of the XOR gate goes high as well. Assuming the cable loop is fully connected, input pin 2 of the XOR gate is also driven to a high condition. With both pins 1 and 2 high, the XOR produces a low output. Once again this is what the EN1210 expects and no alarm is triggered.

However, if during a pulse there is a break in the cable loop, the output high condition can no longer be supplied to input pin 2 of the XOR gate. This produces a condition in the XOR gate where the input on pin 1 is high and the input on pin 2 is low. In this situation the XOR gate produces a high output, which as explained above the EN1210 interprets as not a short circuit and therefore an alarm condition. The EN1210 responds by generating a transmission to the alarm base station to indicate that something is amiss.

It will be noted that if the cable loop is especially long there may be a perceptible difference between the time the pulses arrive at input pins 1 and 2 of the XOR gate. That is, by time the pulse travels the distance of the cable loop it may arrive at the XOR gate's input pin 2 fractionally later than the pulse arrives at input pin 1. During this time difference there will be a high on pin 1 and a low on pin 2 (due to the later arriving pulse coming through the extended cable loop). These momentary different conditions of the XOR gate's input pins cause the XOR gate to emit a short spike of high output. However, the capacitor C3 snuffs out this spike so the EN1210 does not see it and does not trigger an alarm. The result is the cable loop can be longer without generating false positives. It has been found that the circuit described above can be used with a cable loop whose total length is about 350 feet.

It can be seen that with the circuit described herein a cable loop can be used anywhere within transmission range of the EN1210 because the cable loop is self-energized. While it must be physically connected to the inventory items, it need not be electrically connected to anything other than its own cable segments. The generation of only periodic pulses to check for cable loop integrity greatly increases the battery life of the system.

It should be understood that various changes and modifications to the presently preferred embodiments described herein will be apparent to those skilled in the art. Such changes and modification can be made without departing from the spirit and scope of the invention disclosed herein. For example, the alarm circuit could be connected directly to the cable loop, rather than relying on receiving signals from a transmitter. Also, while the invention has been described in terms of an outdoor application, it should be clear that it could just as easily be used indoors. Further, if a single cable segment provides sufficient length, the invention could be used with a single cable segment instead of a plurality of cable segments.

The invention claimed is:

1. An inventory protection system, comprising:

an electrical circuit including:

a) a test pulse generator having an output;

b) a comparison device having first and second inputs and an output;

c) an electrical connection from the output of the test pulse generator to the first input of the comparison device; and d) a reporting unit connected to the output of the comparison device for generating an alarm signal when the first and second inputs of the comparison device are not the same;

a first cable segment having one end attached to a male connector and the other end electrically connected to one of the test pulse generator output and the comparison device's second input;

a second cable segment having one end attached to a female connector and the other end electrically connected to the other of the test pulse generator output and the comparison device's second input;

the male and female connectors of each cable segment being releasably mechanically and electrically connectable to female and male connectors, respectively, of the other cable segment to form a continuous cable loop between the test pulse generator output and the comparison device's second input.

2. The structure of claim 1 further comprising at least one double-ended cable segment having one end attached to a male connector and the other end attached to a female connector, the double-ended cable segment's male and female connectors being mechanically and electrically connectable to the female and male connectors, respectively, of the first and second cable segments to form a continuous cable loop between the test pulse generator output and the comparison device's second input.

3. The structure of claim 1 wherein the other end of the first cable segment is hard wired to one of the test pulse generator output and the comparison device's second input.

4. The structure of claim 1 wherein the other end of the second cable segment is hard wired to the other of the test pulse generator output and the comparison device's second input.

5. The structure of claim 1 wherein the test pulse generator, the comparison device and the electrical connection from the output of the test pulse generator to the first input of the comparison device are mounted on a sensor circuit board.

6. The structure of claim 1 wherein the reporting unit for generating an alarm signal is mounted on a reporting unit circuit board.

7. The structure of claim 1 wherein the reporting unit includes a transmitter for wireless communication with a remote base station.

8. The structure of claim 1 wherein the electrical circuit further comprises a capacitor connected to the output of the comparison device.

9. The structure of claim 1 wherein the comparison device is an exclusive OR gate.

10. The structure of claim 1 wherein the electrical circuit is battery powered.

11. An electrical circuit for an inventory protection system, the circuit comprising:

a test pulse generator having an output;

a comparison device having first and second inputs and an output;

an electrical connection from the output of the test pulse generator to the first input of the comparison device;

a reporting unit connected to the output of the comparison device for generating an alarm signal when the first and second inputs of the comparison device are not the same; and a plurality of cable segments having connectors on the ends thereof to permit pairs of cable segments to be releasably mechanically and electrically connectable to one another to form a continuous cable loop, the ends of the cable loop being connected to the output of the test pulse generator and the second input of the comparison device.

12. The structure of claim 11 wherein the test pulse generator, the comparison device and the electrical connection from the output of the test pulse generator to the first input of the comparison device are mounted on a sensor circuit board.

13. The structure of claim 11 wherein the reporting unit for generating an alarm signal is mounted on a reporting unit circuit board.

14. The structure of claim 11 wherein the reporting unit includes a transmitter for wireless communication with a remote base station.

15. The structure of claim 11 wherein the electrical circuit further comprises a capacitor connected to the output of the comparison device.

16. The structure of claim 11 wherein the comparison device is an exclusive OR gate.

17. The structure of claim 11 wherein the electrical circuit is battery powered.

18. A method of protecting inventory, comprising the steps of:

providing an electrical circuit that generates a periodic test pulse on a test pulse generator output;

connecting said test pulse generator output to a first input of a comparison device having first and second inputs and an output;

connecting a reporting unit to the output of the comparison device and generating an alarm signal when the first and second inputs of the comparison device are not the same; and looping a plurality of cable segments having connectors on the ends thereof through the inventory items and connecting the cable segments to one another to form a continuous cable loop, the ends of the cable loop being connected to the output of the test pulse generator and the second input of the comparison device.

19. The method of claim 18 wherein the reporting unit includes a transmitter further including the step of wirelessly communicating the alarm signal to a remote base station.

20. The method of claim 18 further comprising the step of connecting a capacitor to the output of the comparison device.

* * * * *